US005145428A

United States Patent [19]

Harrison

[11] Patent Number: 5,145,428

[45] Date of Patent: Sep. 8, 1992

[54] SHROUDED PROPELLER SYSTEM FOR A SAILBOAT

[76] Inventor: Serge Harrison, 344 Olivier Avenue, Montreal, Quebec H3Z 2C9, Canada

[21] Appl. No.: 572,605

[22] Filed: Aug. 27, 1990

[51] Int. Cl.[5] ..... B63H 21/32

[52] U.S. Cl. ..... 440/89; 440/67; 440/900

[58] Field of Search ..... 440/38, 47, 49, 66, 440/67, 71, 72, 76, 78, 900; 416/238, 223 R, 242, 245 A, 247 A

[56] References Cited

U.S. PATENT DOCUMENTS

| | | | |
|---|---|---|---|
| 293,777 | 2/1884 | Pearsens | 416/223 R X |
| 909,246 | 1/1909 | Spear | 416/242 |
| 1,023,584 | 4/1912 | Muhlberg | 416/242 |
| 4,545,771 | 10/1985 | Iio | 440/89 |
| 4,778,419 | 10/1988 | Bolle et al. | 440/89 |
| 4,802,872 | 2/1989 | Stanton | 440/89 |

FOREIGN PATENT DOCUMENTS

| | | | |
|---|---|---|---|
| 1149136 | 4/1969 | United Kingdom | 440/67 |

*Primary Examiner*—Edwin L. Swinehart
*Attorney, Agent, or Firm*—Larson and Taylor

[57] ABSTRACT

A propeller system for an outboard motor, comprising a revised propeller, a symmetrical or Kort-type accelerating nozzle, and re-routed exhaust passages, is described. This system permits modification of a standard outboard motor intended for use with a planing type hull to make it applicable to a sailboat immersion type hull. The motor fuel consumption may also be improved.

16 Claims, 3 Drawing Sheets

SHROUDED PROPELLER SYSTEM FOR A SAILBOAT

This invention is concerned with propeller systems either for attachment to an existing outboard motor, or for incorporation into an outboard motor during construction.

As is well known, an outboard motor broadly comprises an internal combustion engine unit, generally encased in a suitable housing, and provided with means to attach it (such as a clamp) generally to the stern transom of a boat. Attached to the base of the engine unit housing is a casing containing both water passages for engine coolant, an exhaust passage, and a propeller drive shaft. At the bottom of the shaft a bevel gear box is provided, in a suitable casing, to the output shaft of which a propeller is attached. This casing will also include inlet and outlet cooling water ports, and will also generally allow the engine exhaust gases to be released into the water. Such outboard motors are commonly used on a variety of small craft, including particularly sailboats of a size which is not large enough to accommodate an inboard motor. Such a sailboat will use an outboard motor for auxiliary power in adverse weather conditions, such as against headwinds and in calm conditions, and, especially, during docking and un-docking maneuvers.

When used in a craft such as a sailboat, a conventional outboard motor exhibits certain significant disadvantages. Outboard motors as currently available were developed primarily for boats utilizing high speed propellers, often with planing hulls. These propellers produce high trust at high propeller speeds (and thus at high engine speeds). These propellers produce very low thrust at lower propeller (and engine) speeds.

However, sailboats do not have planing hulls, but displacement hulls. Consequently, the boat top speed for a sailboat is substantially less than that commonly attained by planing hull craft of shorter overall length. Thus a sailboat cannot utilize the high thrust of the conventional outboard motor as this is only developed at a high engine speed. Contrariwise, a sailboat becomes difficult to control at lower motor speeds more realistic for sailboat use since adequate thrust is not available from the outboard motor. Additionally, operation of an outboard motor under these circumstances is not very economical in fuel consumption.

A further problem is encountered when utilizing a conventional outboard motor as auxiliary power on a sailboat when the propeller is used in reverse. This will be done either as a means of slowing the boat, or to move it backwards, for example in a docking manoeuver. A conventional outboard motor propeller is designed for high forward thrust at high propeller speeds; such a propeller provides very low thrust in the reverse direction, which again serves to complicate handling a sailboat with such a motor. A separate problem also arises when the propeller is reversed, which is that in the conventional outboard motor the exhaust gasses are released through the castings including the propeller drive shaft always in the aft direction. For larger motors, ports passing through the propeller boss are used, and for smaller motors at least one port is usually provided in the lower side of the cavitation plate near the propeller. When moving astern, this gas flow is obstructed by the water flow, which is then in the other direction. This factor contributes to the difficulties of using a conventional outboard motor in a reverse mode.

This invention seeks to overcome these difficulties by providing a combined propeller and nozzle system which seeks to provide when combined with a conventional outboard motor a relatively high level of thrust at low motor and propeller speeds in both the ahead and astern directions, and which vents the exhaust gasses to the output side of the propeller. That is, the exhaust gasses are vented into the turbulence behind the propeller for both forward and reverse directions of rotation of the propeller.

Thus in its broadest aspect this invention comprises a combination of a Kort-type nozzle together with a special propeller, both of which are attached to a conventional outboard motor either as a retrofit kit of parts replacing an existing propeller, or as an integral part of the underwater parts of an outboard motor on construction thereof.

Nozzles of the Kort type are generally well known. Examples of such nozzles are to be found in, amongst others, U.S. Pat. Nos. 3,179,081 (Backhaus, et al); 3,455,268 (Gordon); 4,106,425 (Gruber); 4,509,925 (Wuhrer); 4,694,645 (Flyborg, et al); 4,789,302 (Gruzling); and 4,832,633 (Corle H.) Whilst some of these are concerned with small motors, none of them appear to consider the problems of using an outboard motor with a sailboat or the like.

In a first embodiment this invention seeks to provide an outboard motor unit comprising in combination:

(i) an engine means adapted to drive a propeller in either an ahead or astern direction, and including a housing incorporating means whereby the outboard motor unit is attachable to the hull of a boat;

(ii) a first casing means extending generally downwardly from the housing and including a first propeller drive shaft means, engine coolant water passages, and at least one first engine exhaust passage;

(iii) a second casing means attached to the first casing means and including a second propeller drive shaft driven by the first shaft and extending substantially aft therefrom, engine coolant water passages, and at least one second exhaust passage connected to each first exhaust passage;

(iv) a substantially symmetrical Kort-type accelerating nozzle attached to the second casing concentric about the axis of the second shaft;

(v) a reversible propeller including a boss attached to the second drive shaft and rotatable in a plane substantially perpendicular to the axis of the Kort nozzle at the mid point thereof, wherein (a) the blade pitch decreases outwardly along the length of the blades;

(b) the blade width increases outwardly along the length of the blade; and (c) each blade is curved symmetrically in a plane parallel to the axis of rotation so that both the leading and the trailing edges serve to accelerate water passing over the propeller regardless of the direction of rotation of the propeller;

(vi) at least one first exhaust gas exit port communicating with the second exhaust passage and adapted to vent exhaust gas aft of the nozzle; and (vii) at least one second exhaust gas exit port communicating with the second exhaust passage and adapted to vent exhaust gas forward of the nozzle.

In a second embodiment this invention seeks to provide a propeller and nozzle combination for an outboard motor unit including:

(i) an engine means adapted to drive a propeller in either an ahead or astern direction, and including a housing incorporating means whereby the outboard motor unit is attachable to the hull of a boat;

(ii) a first casing means extending generally downwardly from the housing and including a first propeller drive shaft means, engine coolant water passages, and at least one first engine exhaust passage;

(iii) a second casing means attached to the first casing means and including a second propeller drive shaft driven by the first shaft and extending substantially astern therefrom, engine coolant water passages, and at least one second exhaust passage connected to each first exhaust passage;

wherein the combination comprises:

(iv) a substantially symmetrical Kort-type accelerating nozzle adapted to be attached to the second casing concentric about the axis of the second shaft;

(v) a reversible propeller including a boss adapted to be attached to the second drive shaft and rotatable in a plane substantially perpendicular to the axis of the Kort nozzle at the mid-point thereof, wherein (a) the blade pitch decreases outwardly along the length of the blade;

(b) the blade width increases outwardly along the length of the blade; and (c) each blade is curved symmetrically in a plane parallel to the axis of rotation so that both the leading and the trailing edges serve to accelerate water passing over the propeller regardless of the direction of rotation of the propeller;

(vi) at least one first exhaust gas exit port communicating with the second exhaust passage and adapted to vent exhaust gas aft of the nozzle; and (vii) at least one second exhaust gas exit port communicating with the second exhaust passage and adapted to vent exhaust gas forward of the nozzle.

Preferably, the at least one first exhaust gas exit port comprises a first set of exhaust gas exit ports communicating with the second exhaust gas passage, extending through the propeller boss, and having axes substantially parallel to the second shaft.

Preferably, the at least one second exhaust gas exit port comprises a second set of exhaust gas exit ports communicating with the second exhaust gas passage, in an extension of the propeller boss, having axes substantially perpendicular to the second shaft, and situated between the propeller and the second casing.

Alternatively, the at least one first and at least one second exhaust gas exit ports include either passages in a spacer used in mounting the Kort-type nozzle, and/or ports provided adjacent the nozzle in the second casing.

It can thus be seen that the concepts of this invention can be used in two ways: either as a convenient way to modify an existing outboard motor by discarding the existing propeller and replacing it with the system of this invention, or by incorporating these changes when the motor is being built. In both cases no changes need be made to the outboard motor itself.

The invention will now be described in one embodiment with reference to the attached Figures, in which.

In these Figures like parts have been given the same numbers.

Figure 5:
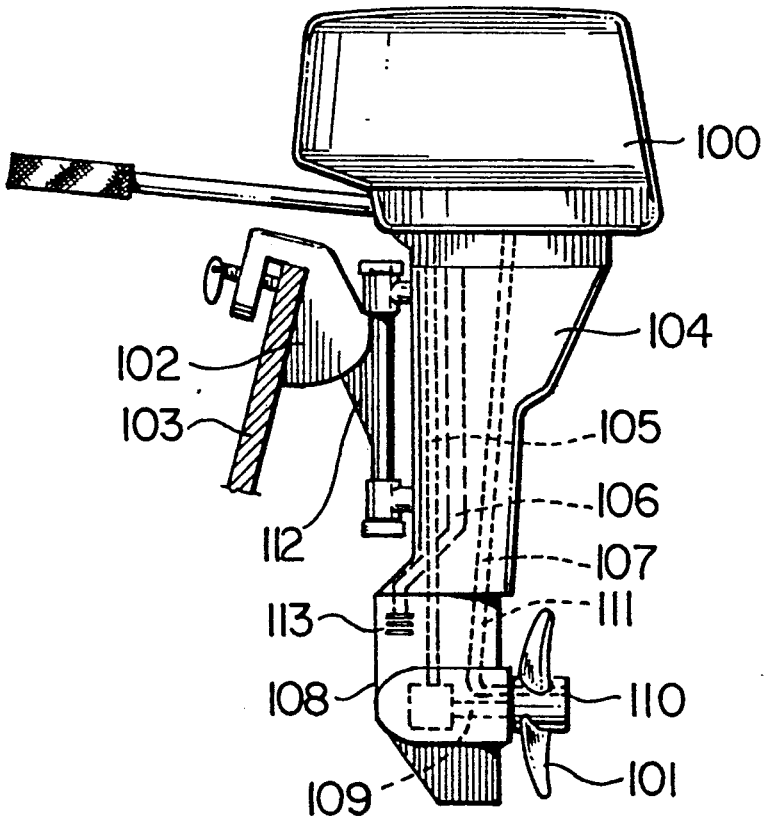
FIG.5 PRIOR ART
FIG. 5 shows in outline a conventional prior art outboard motor unit.

Referring first to FIG. 5, a conventional outboard motor is shown therein. The outboard motor as shown comprises an engine unit shown generally at 100, adapted to drive a propeller, 101, in either an ahead or an astern direction. The outboard motor engine unit also includes a housing, 112, which incorporates a means, 102, whereby the outboard motor unit is attached to the hull of a boat, shown generally at 103. Below the motor unit, a first casing, 104, extends generally downwardly. The casing, 104, incorporates a first propeller drive shaft, 105, engine coolant water passages shown generally at 106, and at least one first engine exhaust passage, as at 107. The bottom of the unit comprises a second casing, 108, attached to the first casing, 104. The second casing includes a second propeller shaft, 109, which is driven by the first shaft, 105, and to which the propeller, 101, is attached. The second propeller shaft extends substantially aft from the first shaft. The second casing includes engine coolant water passages which typically end at a vent, such as is shown at 113, and also includes at least one second exhaust passage 111, in communication with the first exhaust passage, 107, and with at least one exhaust port, 110, passing through the boss of the propeller 101.

Figure 1:
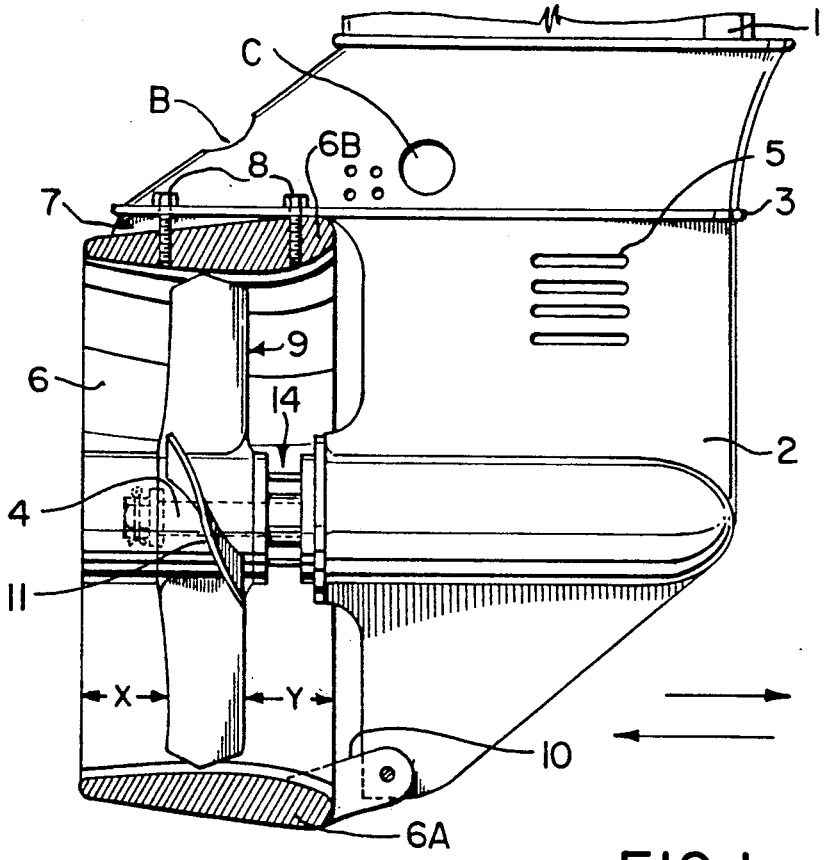
FIG. 1 shows a partially sectioned side view of the lower parts of an outboard motor.

In FIG. 1, the lower parts of an outboard motor modified according to this invention are shown. The first casing, 1, connects upwardly to the motor unit itself (not shown) and includes within it the first propeller drive shaft, water coolant passages, and exhaust gas passages. The first casing is connected to a second casing, 2, which generally includes a motor cavitation plate, 3. The second casing receives the lower end of the first propeller drive shaft, which drives the second propeller shaft, 4, generally through bevel gears (not shown). The second casing includes coolant water ports, as at 5, which are internally connected to the coolant passages in the first casing, and exhaust gas passages.

The Kort nozzle, 6, shown in section at 6A and 6B, is attached to the cavitation plate 3, by means of a shaped spacer 7 (which can be made integrally with the nozzle) by bolts, shown at 8. If the nozzle is built in as the motor is manufactured, the spacer 7 and bolts 8 might be replaced by integral construction methods. The lower periphery of the nozzle is anchored to the bottom of the second casing suitably by the bracket means 10.

Whilst the outer face of the Kort nozzle tapers in a generally aft direction, as can be seen from the sections at 6A and 6B, the internal shape of the nozzle ideally is substantially symmetrical. As a consequence, the accelerating effect of the nozzle in both directions of propeller rotation is substantially equal. Thus the distances X and Y are approximately the same. To the boat user, this means that motor response in terms of power developed is substantially the same both ahead and astern. Experiment has shown that some departure from a symmetrical shape is permissible, provided that it is not such that the perceived performance ahead and astern becomes different. The nozzle types designated as Type 19B and Type 37B by the Maritime Research Institute, Wageningen, The Netherlands, have been found suitable, of which Type 19B is preferred.

Figure 2:
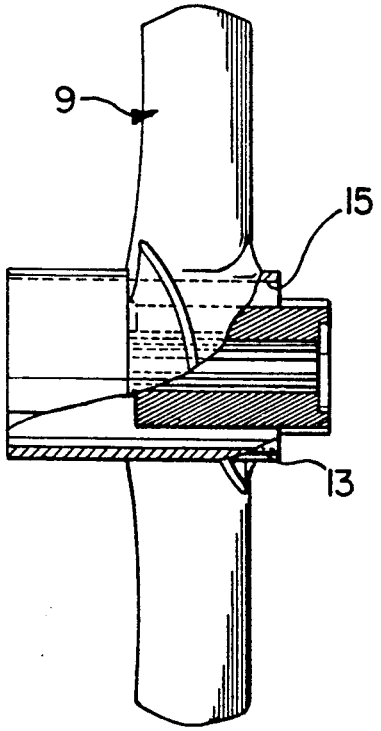
FIG. 2 shows a partially sectioned propeller.
Figure 3:
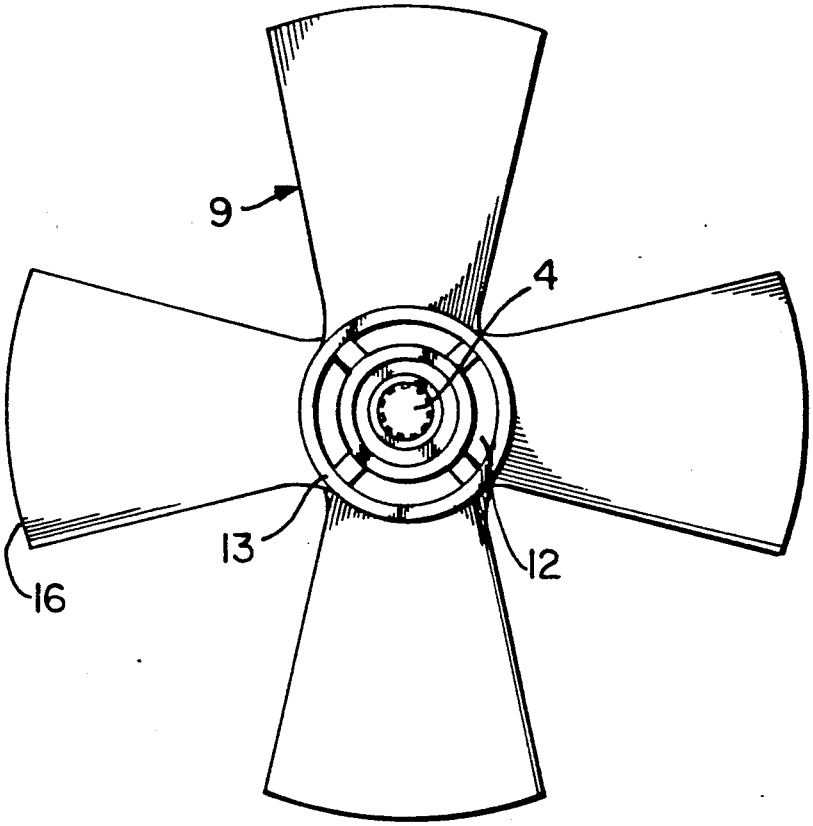
FIG. 3 shows a face view of the propeller of FIG. 2.

The propeller, 9, which as shown has four blades, is mounted onto the second shaft 4 which is at the longitudinal axis of the nozzle. The propeller mounting is adjusted to place the blades 11 centrally at mid-point along the length of the nozzle. The central placement again contributes to similarity of power output ahead and astern. As can be seen in FIG. 1, the blade pitch decreases outwardly along the blade, and as can be seen in FIG. 3, the blades generally widen outwardly along the blade. Further, the blades have a symmetrical curvature (FIGS. 1 and 2) along their entire length so that both the leading and the trailing edges serve to accelerate the water as the propeller rotates in either direction. Again, the symmetry contributes to similarity of power output ahead and astern.

The propeller boss also provides two routes whereby the motor exhaust gasses are vented. The first, and conventional one, comprises a plurality of arcuate passages 12 which pass through the propeller boss 13 substantially parallel to the shaft 4. When the boat is travelling ahead, the exhaust gasses are then vented through these ports into the turbulence behind the propeller. A second set of ports 14 is also provided located between the boss 13 and the casing 2. These can be obtained either by cutting away the extension to the boss as at 15 in FIG. 2, or by providing a suitable slotted spacer between the boss and the casing 3 on the shaft 4. When the boat is heading astern, the exhaust gasses are vented through the second set of ports again into the turbulence behind the propeller, thus relieving any hydrostatic back pressure which would otherwise arise on the exhaust system, and which interferes with motor operation.

It has also been found that the blade tips 16 should be shaped to match the inside curve of the nozzle, and preferably the gap between the blade tips and the nozzle should be as small as is possible.

In practice it has been found that this arrangement of Kort nozzle and propeller significantly improves the handling and control of a sailboat hull when powered by an otherwise conventional outboard motor, intended for use with a planing-type hull. Further, it appears that fuel economy is also improved; in comparison testing using a sailboat which is outboard motor driven at a speed of about 6 knots a fuel saving of about 15% has been observed.

Figure 4:
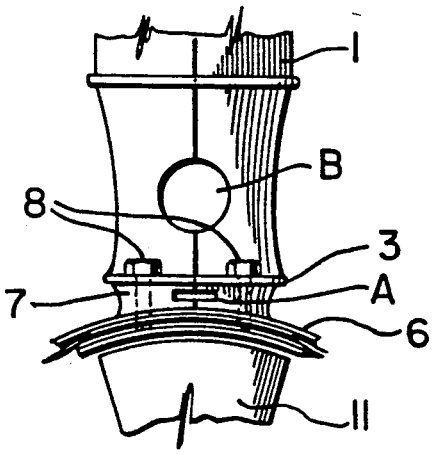
FIG. 4 shows a face view of part of the assembly of FIG. 1.

In the proceeding discussion of FIGS. 1 through 4 a specific embodiment is described for one embodiment of this invention. There are two relatively important ways in which this construction may need to be changed, when a Kort nozzle and matching propeller are being attached as a retrofit kit to an existing outboard motor. These concern the positioning of the Kort nozzle and the re-routing of the exhaust gasses.

Where the Kort nozzle is concerned, its position is constrained by the fact that the position of the propeller shaft also determines the axis of the nozzle. The performance desired from the outboard motor after modification will indicate the desired propeller and nozzle diameters. Finally, the nozzle itself must be adequately robust to withstand the load placed upon it. Reaching a workable compromise between these competing factors may require that the cavitation plate is modified rather more than is shown in FIGS. 1 and 4, so that in effect it becomes part of the nozzle. For example instead of being simply bolted up onto the underside of the cavitation plate, as shown in FIGS. 1 and 4, the cavitation plate could be modified to provide a tongue or tab which mates with a slot or recess provided in the nozzle.

Turning now to the venting of the exhaust gasses, the construction shown in the Figures is one that is appropriate for a larger outboard motor. In some smaller outboard motor designs the exhaust gasses are vented through a port which points downwardly and aft through the cavitation plate. The gasses are vented into the turbulence a short distance aft of the propeller when moving ahead. Problems with motor performance still arise when moving astern with the propeller reversed, since the exhaust port is then pointing toward the oncoming water, and the gasses are being exhausted into the undisturbed water ahead of the propeller. Further, fitting of a nozzle to such an engine will effectively obstruct such a downwardly oriented exhaust port. Where new construction is concerned, adequate steps can be taken to re-route the exhaust gasses, for example through the propeller boss. In a retrofit situation, at least two options are available, depending to a degree on the size of the nozzle and the separation between the cavitation plate and the propeller shaft axis.

If the nozzle size is such that a spacer, as at 7 in FIG. 4 is in use, then if the spacer is deep enough the exhaust gasses can be re-routed by providing exhaust ports through the spacer, as shown for example schematically at A in FIG. 4, pointing both fore and aft, and connecting with the second exhaust passage in the upper part of the second casing. By this means the exhaust gasses are always exhausted through a port towards the propeller race.

If the nozzle size is such that re-routing the gasses through such a spacer is not possible, then it is necessary to modify the casings to provide new exhaust ports. Usually a single port pointing astern will be sufficient, but one each side of the casing pointing ahead may be found necessary, as shown schematically at B or C in FIG. 1.

In this situation it is not desirable simply to provide a replacement single exhaust port pointing astern, since the water pressure onto the exhaust system will adversely affect motor performance when moving astern, especially if the motor utilizes a two stroke engine. The performance of such an engine is directly affected by any back pressure in its exhaust system. Therefore, failure to provide exhaust ports not influenced by water flow direction may serve to affect adversely the ability to provide an outboard motor with substantially the same percieved performance in both the ahead and astern directions.

The embodiments of the invention in which an exclusive property or privilege is claimed are defined as follows:

1. An outboard motor unit comprising in combination:

(i) an engine means adapted to drive a propeller in either an ahead or astern direction, and including a housing incorporating means whereby the outboard motor unit is attachable to the hull of a boat;

(ii) a first casing means extending generally downwardly from the housing and including a first propeller drive shaft means; engine coolant water passages, and at least one first engine exhaust passage;

(iii) a second casing means attached to the first casing means and including a second propeller drive shaft driven by the first shaft and extending substantially aft therefrom, engine coolant water passages, and at least one second exhaust passage connected to each first exhaust passage;

(iv) a substantially symmetrical accelerating nozzle attached to the second casing concentric about the axis of the second shaft;

(v) a reversible propeller including blades and a boss attached to the second drive shaft and rotatable in a plane substantially perpendicular to the axis of the Kort nozzle at the mid-point thereof, wherein (a) the blade pitch decreases outwardly along the length of the blade;

(b) the blade width increases outwardly along the length of the blade; and (c) each blade is curved symmetrically in a plane parallel to the axis of rotation so that both the leading and the trailing edges serve to accelerate water passing over the propeller regardless of the direction of rotation of the propeller;

(vi) at least one first exhaust gas exit port communicating with the second exhaust passage and adapted to vent exhaust gas aft of the nozzle; and (vii) at least one second exhaust gas exit port communicating with the second exhaust passage and adapted to vent exhaust gas forward of the nozzle, said at least one first exhaust gas exit port and passage venting substantially all exhaust gasses into the turbulence downstream of the propeller for forward direction of rotation of the propeller, and said at least one second exhaust gas exit port and passage venting substantially all exhaust gasses into the turbulence downstream of the propeller for reverse direction of rotation of the propeller; whereby substantially none of the exhaust gasses are introduced into the relatively undisturbed water upstream of the propeller.

2. A motor unit according to claim 1 wherein the nozzle is internally shaped so as to provide substantially the same power ahead and astern.

3. A motor unit according to claim 1 wherein the propeller has at least three blades.

4. A motor unit according to claim 1 wherein the propeller has four blades.

5. A motor unit according to claim 1 wherein:

(i) the at least one first exhaust gas exit port comprises a first set of exhaust gas exit ports communicating with the second exhaust gas passage, extending through the propeller boss, and having axes substantially parallel to the second shaft; and (ii) the at least one second exhaust gas exit port comprises a second set of exhaust gas exit ports communicating with the second exhaust gas passage, in an extension of the propeller boss, having axes substantially perpendicular to the second shaft, and situated between the propeller and the second casing.

6. A motor unit according to claim 1 wherein the at least one first exhaust gas exit port is included in the attachment of the nozzle to the second casing.

7. A motor unit according to claim 1 wherein the at least one first exhaust gas exit port is included in the second casing.

8. A motor unit according to claim 1 wherein the at least one second exhaust gas exit port is included in the second casing.

9. A propeller and nozzle combination for an outboard motor unit including:

(i) an engine means adapted to drive a propeller in either an ahead or astern direction, and including a housing incorporating means whereby the outboard motor unit is attachable to the hull of a boat;

(ii) a first casing means extending generally downwardly from the housing and including a first propeller drive shaft means; engine coolant water passages, and at least one first engine exhaust passage;

(iii) a second casing means attached to the first casing means and including a second propeller drive shaft driven by the first shaft and extending substantially aft therefrom, engine coolant water passages, and at least one second exhaust passage connected to each first exhaust passage;

wherein the combination comprises:

(iv) a substantially symmetrical accelerating nozzle adapted to be attached to the second casing concentric about the axis of the second shaft;

(v) a reversible propeller including blades and a boss attached to the second drive shaft and rotatable in a plane substantially perpendicular to the axis of the nozzle at the mid-point thereof, wherein (a) the blade pitch decreases outwardly along the length of the blade;

(b) the blade width increases outwardly along the length of the blade; and (c) each blade is curved symmetrically in a plane parallel to the axis of rotation so that both the leading and the trailing edges serve to accelerate water passing over the propeller regardless of the direction of rotation of the propeller;

(vi) at least one first exhaust gas exit port communicating with the second exhaust passage and adapted to vent exhaust gas aft of the nozzle; and (vii) at least one second exhaust gas exit port communicating with the second exhaust passage and adapted to vent exhaust gas forward of the nozzle, said at least one first exhaust gas exit port and passage venting substantially all exhaust gasses into the turbulence behind the propeller for forward direction of rotation of the propeller, and said at least one second exhaust gas exit port and passage venting substantially all exhaust gasses into the turbulence behind the propeller for reverse direction of rotation of the propeller whereby substantially none of the exhaust gasses are introduced into the relatively undisturbed water upstream of the propeller.

10. A combination according to claim 9 wherein the nozzle is internally shaped so as to provide substantially the same power ahead and astern.

11. A combination according to claim 9 wherein the propeller has at least three blades.

12. A combination according to claim 9 wherein the propeller has four blades.

13. A combination according to claim 9 wherein:

(i) the at least one first exhaust gas exit port comprises a first set of exhaust gas exit ports communicating with the second exhaust gas passage, extending through the propeller boss, and having axes substantially parallel to the second shaft; and (ii) the at least one second exhaust gas exit port comprises a second set of exhaust gas exit ports communicating with the second exhaust gas passage, in an extension of the propeller boss, having axes substantially perpendicular to the second shaft, and situated between the propeller and the second casing.

14. A combination according to claim 9 wherein the at least one first exhaust gas exit port is included in the attachment of the nozzle to the second casing.

15. A combination according to claim 9 wherein the at least one first exhaust gas exit port is included in the second casing.

16. A combination according to claim 9 wherein the at least one second exhaust gas exit port is included in the second casing.

* * * * *